US006640061B2

(12) United States Patent
Higgins et al.

(10) Patent No.: US 6,640,061 B2
(45) Date of Patent: Oct. 28, 2003

(54) SENSING SYSTEM FOR DETECTING A FULL CONDITION WITHIN A WASTE DEVELOPER SYSTEM

(75) Inventors: Thomas E. Higgins, Fairport, NY (US); Paul W. Burnham, Webster, NY (US); William H. Wayman, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/975,785

(22) Filed: Oct. 11, 2001

(65) Prior Publication Data

US 2003/0072577 A1 Apr. 17, 2003

(51) Int. Cl.[7] ..... G03G 21/10
(52) U.S. Cl. ..... 399/35; 399/358
(58) Field of Search ..... 399/12, 13, 35, 399/358, 360

(56) References Cited

U.S. PATENT DOCUMENTS

| | | | | |
|---|---|---|---|---|
| 4,912,512 A | * | 3/1990 | Midorikawa et al. | 399/12 |
| 5,500,716 A | * | 3/1996 | Morishita et al. | 399/35 |
| 5,839,017 A | * | 11/1998 | Mordenga | 399/35 |
| 5,890,049 A | | 3/1999 | Williams et al. | 399/360 |
| 5,893,007 A | * | 4/1999 | Lim | 399/13 |

* cited by examiner

*Primary Examiner*—William J. Royer
(74) *Attorney, Agent, or Firm*—Lloyd F. Bean, II

(57) ABSTRACT

A sensing system for detecting a full condition within a waste developer system, the sensing system including a developer waste container for receiving and holding waste developer material comprising toner and carrier deposited therein from a developer system; a sensor assembly mounted exterior to the developer waste container, the sensor including a reed switch being responsive to the level of material in the developer waste container when the material in the developer waste container reaches a predetermined level.

9 Claims, 2 Drawing Sheets

SENSING SYSTEM FOR DETECTING A FULL CONDITION WITHIN A WASTE DEVELOPER SYSTEM

BACKGROUND OF THE INVENTION

This invention relates to electrophotographic copiers and duplicators and, more particularly to a waste container and an indicating system for warning a machine operator of impending overfilling of the waste container.

In the process of electrostatographic printing, an electrostatic charge pattern or latent image corresponding to an original document to be reproduced is recorded on an insulating medium. A viewable record is produced by developing the latent image with particles of granulated material to form a powder image thereof. Thereafter, the visible powder image is fused to the insulating medium, or transferred to a suitable support material and fused thereto. Development of the latent image is achieved by bringing a developer mix into contact therewith. Typical developer mixes generally comprise dyed or colored thermoplastic particles of granulated material known in the art as toner particles, which are mixed with carrier granules, such as ferromagnetic granules. When appropriate, toner particles are mixed with carrier granules and the toner particles are charged triboelectrically to the correct polarity. As the developer mix is brought into contact with the electrostatic latent image, the toner particles adhere thereto. However, as toner particles are depleted from the developer mix, additional toner particles (simply "toner" hereafter) must be supplied. In this way, the concentration of toner in the developer mix is maintained substantially constant.

In developer subsystems that employ so-called trickle development, a small amount of fresh carrier is included with the supply of toner which is dispensed by a dispensing apparatus into the developer subsystem. Generally, this system employs an overflow system in the housing of the developer subsystem which maintains the sump at a constant volume. The carrier is often coated with materials that assist in creation of the toner's triboelectric charge. It is necessary to control the average carrier age (i.e. time used in development) in order to maintain its effectiveness in assisting in the creation of triboelectric charge on the toner. The method of controlling average age is to continuously add fresh carrier and remove some of the used carrier as waste.

In machines where the removal and replacement of waste containers is a task performed by a Customer/User, it is highly desirable to have an accurate method for indicating when the waste container is full so that Customers/Users are not dissatisfied by replacing a waste container which is not fully used or by overflow of a full container.

Typically, waste containers, such as a bottle, tend to be made from polypropylene or polyethylene. A natural color is generally chosen because the bottle is used in conjunction with an optical sensor which indicates when the bottle is at its full capacity. These optical sensors consist of an emitter and a detector which detect when the bottle is full by looking through a view window on the bottle or through the bottle directly. A problem with such systems is that toner contamination on the view window can trigger false readings; when the inside of the bottle becomes dusty, the sensor misinterprets this condition as a full bottle.

An alternative method that has been used in this type of application involves counting the number of copies since the bottle was last installed. This approach is not only indirect, but also inaccurate due to a wide variation in the amount of waste developer generated per copy. The inaccuracy correspondingly causes frequent bottle replacements and higher service costs. A means is needed to detect when a waste container from a xerographic development process is full in order to prevent overflow and backup of waste into the developer subsystem. A means is also needed to detect if the waste container is not fully installed in order to prevent dumping of waste into the system or environment.

BRIEF SUMMARY OF THE INVENTION

There is provided a sensing system for detecting a full condition within a waste developer system, said sensing system including a developer waste container for receiving and holding waste developer material comprising toner and carrier deposited therein from a developer system; a sensor assembly mounted exterior to the developer waste container, said sensor including a reed switch being responsive to the level of material in said developer waste container when the material in said developer waste container reaches a predetermined level.

Other features of the present invention will become apparent as the following description proceeds and upon reference to the drawings.

DETAILED DESCRIPTION OF THE PREFERRED EMBODIMENT OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
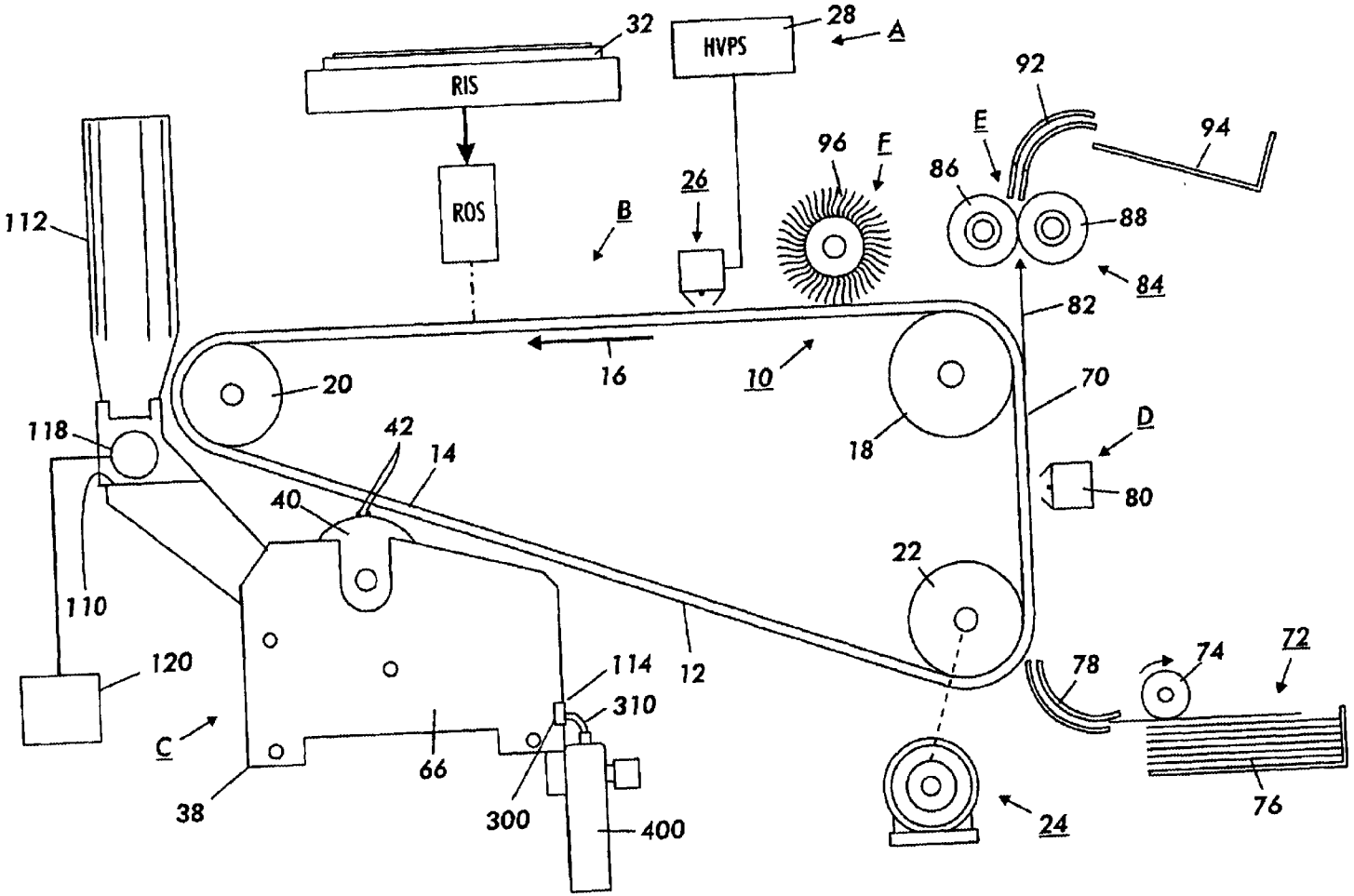
FIG. 3 is a schematic elevational view of an illustrative electrophotographic printing machine incorporating a waste container having the features of the present invention therein.

Referring initially to FIG. 3, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from selenium alloy. Conductive substrate 14 is made preferably from an aluminum alloy that is electrically grounded. One skilled in the art will appreciate that any suitable photoconductive belt may be used. Belt 10 moves in the direction of arrow 16 to advance successive portions of photoconductive surface 12 sequentially through the various processing stations disposed throughout the path of movement thereof. Belt 10 is entrained about stripping roller 18, tensioning roller 20 and drive roller 22. Drive roller 22 is mounted rotatably in engagement with belt 10. Motor 24 rotates drive roller 22 to advance belt 10 in the direction of arrow 16. The drive roller 22 is coupled to motor 24 by suitable means, such as a drive belt. Belt 10 is maintained in tension by a pair of springs (not shown) resiliently urging tensioning roller 20 against belt 10 with a desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps flash light rays onto original document 30. The light rays reflected from original document 30 are transmitted through raster input scanner (RIS) to form an image thereof. Raster output scanner (ROS) focuses this light image onto the charged portion of photoconductive surface 12 to selectively dissipate the charge thereon. This records an electrostatic latent image on photoconductive surface 12 that corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface 12. Preferably, developer unit 38 includes donor roll 40 and electrode wires 42. Electrode wires 42 are electrically biased relative to donor roll 40 to detach toner therefrom so as to form a toner powder cloud in the gap between the donor roll 40 and the photoconductive surface 12. The latent image attracts toner particles from the toner powder cloud forming a toner powder image thereon. Donor roll 40 is mounted, at least partially, in the chamber of developer housing 66. The chamber in developer housing 66 stores a supply of developer material. In one embodiment the developer material is a single component development material of toner particles, whereas in another the developer material includes at least toner and carrier.

With continued reference to FIG. 3, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly, indicated generally by the reference numeral 84, which permanently affixes the transferred powder image to sheet 70. Fuser assembly 84 includes a heated fuser roller 86 and a back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 92 to catch tray 94 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

As successive electrostatic latent images are developed, the toner particles within the developer material are depleted. Toner is received from a toner dispenser indicated generally by reference numeral 110. The supply of toner is maintained in container 112 and is introduced to development sump 114 via auger 116 which is driven at a constant rate whenever motor 118 is energized by toner control system 120, as described in U.S. Pat. No. 5,081,491. As new toner with carrier enters sump 114, toner and carrier exits through overflow exit 300 and moves to waste toner bottle 400 via hose 310.

Figure 1:
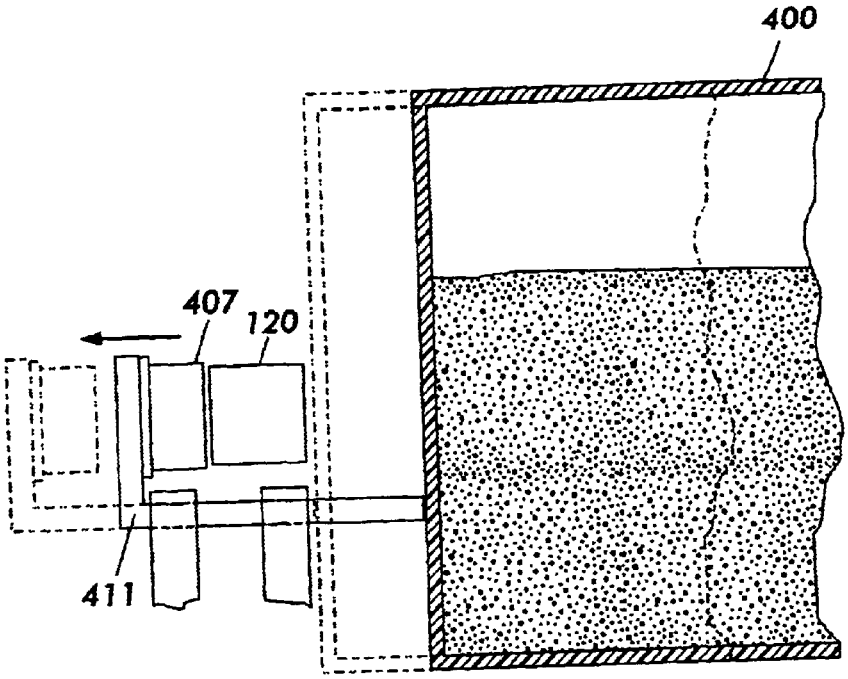
FIGS. 1 and 2 are schematic elevational views showing an embodiment of the present invention.
Figure 2:
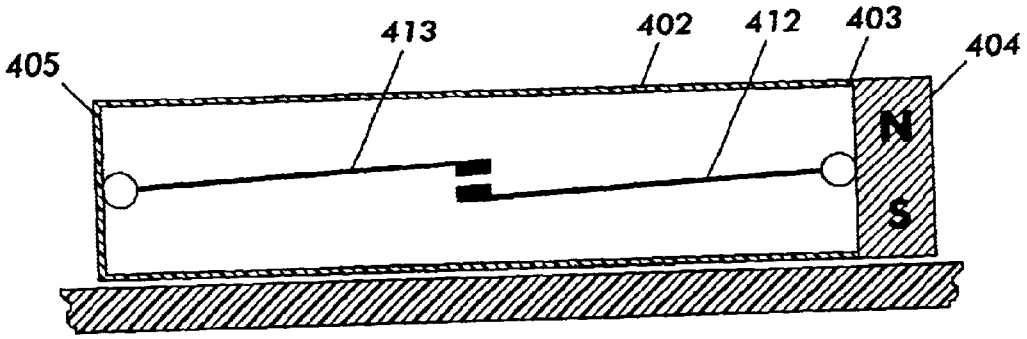

Referring to FIGS. 1 and 2, sensor 120 is mounted adjacent to waste container 400. Sensor 120 includes a reed switch 402, and a bar magnet 404, mounted in fixed positions flat against or in proximity to the waste container 400. Reed switch 402 contains ferromagnetic contact blades 412 and 413, hermetically sealed in a glass envelope which is filled with an inert gas or vacuum. The reed switch 402 can be operated by an externally generated magnetic field passing through the longitudinal axis of the reed switch 402, either from a coil or a permanent magnet. One end 403 of the reed switch 402 is midway between the poles of the bar magnet 404 in which the longitudinal axes of the reed switch 402 and north-south poles of the bar magnet 404 are at right angles to each other. The other end 405 of the reed switch 402 and one pole of the bar magnet 404 both lie in a common horizontal plane. A bar 407 of ferrous material is mounted on a movable assembly 411. The movable assembly 411 moves bar 407 away from reed switch 402 when the waste container 400 is present. The advantagous feature of the present invention are (1) the relatively perpendicular alignment of the reed switch 402 longitudinal axis with the magnetic north-south axis, (2) the placement of one end of the reed switch 402 midway between the poles of the bar magnet 404 and (3) the free end 405 of the reed switch 402 and at least one pole of the bar magnet 404 may be brought simultaneously in proximity with a mass of magnetically permeable material or object while at the same time the other pole of the bar magnet 404 is as far away as possible from this permeable material or object. This arrangement enables the detection of a magnetically permeable material or objects to which it is not feasible to attach a bar magnet 404.

In operation, when the waste container 400 is not installed the bar 407 is moved by the movable assembly 411 to a position against or in close proximity to both the reed switch 402 and one pole of the bar magnet 404 with the ferrous bar's upper-most edge horizontal and in or near the same plane as the reed switch 402 in such a way that the ferrous bar magnetically couples the one pole of the bar magnet 404 to the reed switch 402 so as to operate the reed switch 402 by causing contact blades 412 and 413 to contact.

When an empty carrier waste container 400 is installed the movable assembly 411 moves bar 407 away from the reed switch 402 in such a way that the bar 407 no longer magnetically couples the reed switch 402 to sufficiently operate the reed switch 402, and the reed switch 402 assumes its non-operating state.

When an installed waste container 400 fills with carrier and reaches a predefined height in waste container 400, the ferrous carrier magnetically couples the other pole of the bar magnet 404 to the reed switch 402 sufficiently to operate the reed switch 402.

When the reed switch 402 is operated a signal is generated. The signal can be sent to a user interface to indicate to the operator to check the waste container 400 and/or shut down the machine.

This invention has the following advantages over the present design: Less expensive to make due to fewer parts, less expensive parts (reed switch vs. optical switch), and fewer assembly, test and adjustment operations due to fewer moving parts. More reliable due to fewer moving parts and the use of a sealed sensor (reed switch) as opposed to an optical switch that can be occluded with waste toner and carrier.

It is, therefore, apparent that there has been provided in accordance with the present invention that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. In a sensing system for detecting a full condition within a waste developer system, said sensing system comprising: a developer waste container for receiving and holding waste developer material comprising toner and carrier deposited therein from the waste developer system, a sensor assembly mounted exterior to the developer waste container, said sensor assembly including a reed switch being responsive to the level of material in said developer waste container when the developer material in said developer waste container reaches a predetermined level, said sensor assembly further comprises a magnet, adjacent to said reed switch and developer waste container, one pole of said magnet in proximity to the developer material in said developer waste container to operate said reed switch when the developer material reaches said predetermined level, said reed switch has a first and second end, said magnet is positioned so that said first end of the reed switch is midway between the poles of the magnet in which the longitudinal axes of the reed switch and the north-south axis of the magnet are at right angles to each other.

2. The system of claim 1, wherein the second end of the reed switch and one pole of the magnet both contact the developer waste container so as to be simultaneously in proximity to the carrier in a full container.

3. A system for detecting ferrous material in a container comprising:

a sensor assembly mounted exterior to the container, said sensor assembly including a reed switch being responsive to the level of the ferrous material in said container when the ferrous material reaches a predetermined level, said sensor assembly further comprises a magnet, adjacent to said reed switch and said container, wherein one pole of said magnet is positioned near the ferrous material in said container to operate said reed switch when the ferrous material reaches said predetermined level, said reed switch has a first and second end, said magnet is positioned so that said first end of the reed switch is midway between the poles of the magnet in which the longitudinal axes of the reed switch and the magnet are at right angles to each other.

4. The system of claim 3, wherein the second end of the reed switch and one pole of the magnet both lie in a common horizontal plane.

5. A device for a machine comprising:

a sensor assembly having a first mode of operation for sensing an amount of ferrous material in a container of the machine and a second mode of operation for sensing the presence of the container within the machine, said sensor assembly is mounted exterior to the container, said sensor assembly including a reed switch being responsive to the level of the ferrous material in said container when the ferrous material in said container reaches a predetermined level.

6. The device of claim 5, wherein said sensor assembly further comprises a magnet, adjacent to said reed switch and container, one pole of said magnet the ferrous material in said container to operate said reed switch when the ferrous material reaches said redetermined level in said first mode of operation.

7. The device of claim 6, wherein said reed switch has a first and second end, said magnet is positioned so that said first end of the reed switch is midway between the poles of the magnet in which the longitudinal axes of the reed switch and the north-south axis of the magnet are at right angles to each other.

8. The device of claim 7, wherein the second end of the reed switch and one pole of the magnet both lie in a common horizontal plane.

9. The device of claim 7, wherein said sensor assembly further comprises a bar of ferrous material mounted on a movable assembly, said movable assembly contacts said container and moves said bar away from said reed switch and a magnet assembly when said container is present in the machine, when said container is not present in the machine, the movable assembly moves said bar adjacent to said reed switch and magnet assembly, one pole of said magnet and the other end of the reed switch simultaneously contacting with the bar to operate said reed switch in said second mode of operation.

* * * * *